US008578821B2

(12) United States Patent
Hulings et al.

(10) Patent No.: US 8,578,821 B2
(45) Date of Patent: Nov. 12, 2013

(54) OIL FILTER WRENCH

(75) Inventors: Ryan Hulings, Emporia, KS (US); Mike Williams, Emporia, KS (US)

(73) Assignee: Hopkins Manufacturing Corporation, Emporia, KS (US)

( * ) Notice: Subject to any disclaimer, the term of this patent is extended or adjusted under 35 U.S.C. 154(b) by 250 days.

(21) Appl. No.: 13/211,454

(22) Filed: Aug. 17, 2011

(65) Prior Publication Data

US 2013/0042724 A1 Feb. 21, 2013

(51) Int. Cl.

| | |
|---|---|
| ***B25B 13/52*** | (2006.01) |
| ***B25B 27/00*** | (2006.01) |
| ***B25B 13/00*** | (2006.01) |

(52) U.S. Cl.

CPC ..... *B25B 13/00* (2013.01); *B25B 13/52* (2013.01); *B25B 27/0042* (2013.01)

USPC ..... 81/64

(58) Field of Classification Search

USPC ..... 81/3.43, 64, 65.2

See application file for complete search history.

(56) References Cited

U.S. PATENT DOCUMENTS

| | | | | |
|---|---|---|---|---|
| 2,132,207 | A * | 10/1938 | Donovan | 81/3.43 |
| 2,317,037 | A * | 4/1943 | Donovan | 81/3.43 |
| 5,307,712 | A | 5/1994 | Pratt | |
| 5,323,671 | A | 6/1994 | Hebert | |
| 5,388,485 | A | 2/1995 | Auble | |
| 5,507,210 | A | 4/1996 | Paramest | |
| 6,431,032 | B1 * | 8/2002 | Kuryan et al. | 81/64 |
| 7,896,570 | B2 | 3/2011 | Gannon et al. | |
| 2010/0050821 | A1 * | 3/2010 | Pullen | 81/64 |

* cited by examiner

*Primary Examiner* — David B Thomas

(74) *Attorney, Agent, or Firm* — Hovey Williams LLP

(57) ABSTRACT

An oil filter wrench for use in tightening or loosening an oil filter includes a band assembly configured to be placed over the oil filter; a handle assembly attached to the band assembly for use in tightening and turning the band assembly; and a layer of flexible or compressible high friction material applied over a portion of the band assembly to reduce slippage between the band assembly and the oil filter.

10 Claims, 3 Drawing Sheets

OIL FILTER WRENCH

BACKGROUND

Automobile engines and other internal combustion engines typically include oil filters that must be periodically removed and replaced. Because oil filters are difficult to remove and install by hand, many different types of oil filter wrenches have been developed for this purpose.

Even when using oil filter wrenches, oil filters can be difficult to remove or install because they often become coated with slippery oil, grease, and/or other lubricants. Oil filter wrenches with teeth, spikes, sandpaper, and other projections on their filter-engaging surfaces have been developed to improve their gripping ability, but these types of wrenches often damage or even destroy the oil filters as they are being installed or removed and therefore can only practically be used for removing spent oil filters and not for installing new ones. Moreover, these oil filter wrenches can cut or otherwise irritate a user's hands when used or otherwise handled.

Accordingly, there is a need for an improved oil filter wrench that overcomes the limitations of the prior art.

SUMMARY

The present invention solves the above-described problems and provides a distinct advance in the art of oil filter wrenches by providing an oil filter wrench that effectively loosens and tightens spent and new oil filters without damaging the oil filters or irritating a user's hands.

An oil filter wrench constructed in accordance with an embodiment of the invention broadly comprises a band assembly configured to be placed over an oil filter; a handle assembly attached to the band assembly for use in tightening and turning the band assembly to tighten or loosen the oil filter; and a layer of high friction material applied over a portion of the band assembly. The high friction material is a relatively soft, compressible, and "sticky" or high friction material such as PVC or polyurethane that is applied in a dip process, powder coating process, or by mechanical attachment. When the band assembly is tightened against an oil filter, the high friction material compresses against the oil filter to securely grip the oil filter but does not penetrate or scrape the outer shell of the oil filter. The high friction material may also enhance a user's grip on the wrench without irritating the user's hands.

In one embodiment, the high friction material is applied over a portion of the inner surface, outer surface, and side edges of the band assembly to reduce slippage between the inner surface of the band assembly and the oil filter and to improve a user's grip on the outer surface of the band assembly. In another embodiment, the high friction material is applied over a portion of the inner surface and side edges of the band assembly but not the outer surface. In yet another embodiment, the high friction material consists of a series of spaced-apart strips applied over a portion of the inner band surface, outer band surface, and side edges. In another embodiment, the strips can be applied over a portion of the inner surface only by mechanical or adhesive attachment. The strips may extend parallel or perpendicular to a major axis of the band assembly.

This summary is provided to introduce a selection of concepts in a simplified form that are further described in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
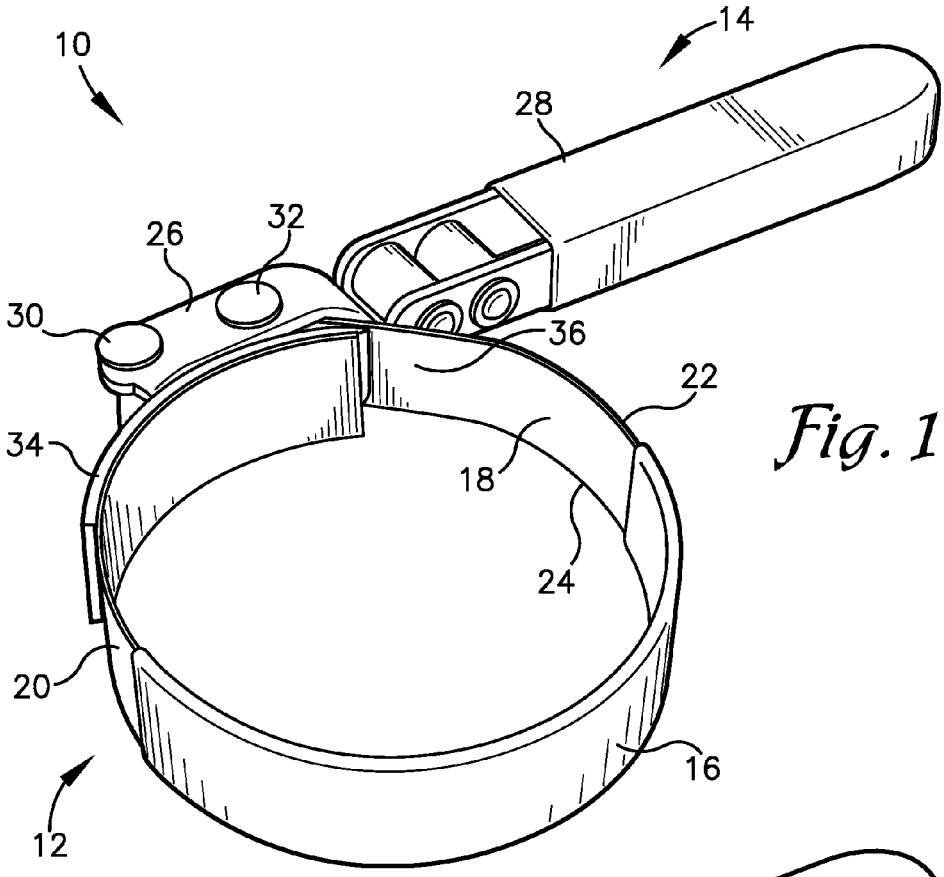
FIG. 1 is a perspective view of an oil filter wrench constructed in accordance with an embodiment of the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of embodiments of the invention references the accompanying drawings. The embodiments are intended to describe aspects of the invention in sufficient detail to enable those skilled in the art to practice the invention. Other embodiments can be utilized and changes can be made without departing from the scope of the claims. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

The present invention provides an oil filter wrench that effectively loosens and tightens spent and new oil filters without damaging the oil filters or irritating a user's hands. An oil filter wrench 10 constructed in accordance with an embodiment of the invention is illustrated in FIG. 1 and broadly comprises a band assembly 12; a handle assembly 14; and a layer of high friction material 16 applied over a portion of the band assembly.

The band assembly 12 is conventional and is configured to be placed over an oil filter and tightened and turned by the handle assembly 14. The band assembly may be formed of metal, plastic, or any other suitable material, and has an inner band surface 18, an outer band surface 20, and side edges 22,24 between the inner and outer band surfaces.

The handle assembly 14 is also conventional and is provided for tightening the band assembly 12 on an oil filter and for turning the band assembly and the oil filter. The handle assembly 14 includes a band attachment portion 26 and a handle portion 28. The band attachment portion 26 includes a pair of spaced apart pivot pins 30,32. One end 34 of the band assembly is attached to the first pivot pin 30 and an opposite end 36 of the band assembly is attached to the second pivot pin 32 to permit tightening of the band assembly in a conventional manner. The handle portion 28 is pivotally coupled to the band attachment portion 26 so that the handle portion may be positioned in different angles with respect to the band assembly to assist with the removal and/or replacement of oil filters in hard to reach places. The oil filter wrench may also include a band assembly with a conventional metal band half and a chain half.

The layer of high friction material 16 is applied over a portion of the band assembly 12 to improve its grip on oil filters. In the embodiment of FIG. 1, the high friction material 16 is applied over a portion of the inner band surface 18, outer band surface 20, and side edges 22,24. In some embodiments, the layer of high friction material 16 is applied over approximately 50% of the inner band surface 18, outer band surface 20, and side edges 22,24. In another embodiment, the layer of high friction material 16 is applied over approximately 25% of the inner band surface 18, outer band surface 20, and side edges 22,24. In yet another embodiment, the layer of high friction material 16 is applied over 5% or more of the inner band surface, outer band surface, and side edges.

When the band assembly 12 is tightened against an oil filter, the high friction material 16 compresses against the oil filter to securely grip it without penetrating or scraping its outer shell. Because the high friction material 16 is applied over both the inner and outer band surfaces 18,20, it reduces slippage between the band assembly and the oil filter and improves a user's grip on the oil filter wrench 10. In addition, the high friction material on the outer and side surfaces of the band aids the user in locating the band on the filter or removing the band. Without the high friction material on these surfaces the band can be slippery, making it hard to move since one's fingers will slide on the band. The increased grip provided by these surfaces increases ease of operation.

The high friction material 16 may be any relatively soft, compressible, and sticky material. In one embodiment, the material is PVC material that is approximately 0.030" thick. This thickness may be uniform or variable for both gripping and processing reasons. In addition, voids could be created between the band and the coating to provide a variable height surface to provide increased grip. In another embodiment, the high friction material is a different plastic material that is approximately 0.100" thick. The high friction material may be applied to the band assembly in a dipping process, a powder coating process, or mechanical or adhesive attachment.

To prevent the layer of high friction material from sliding or otherwise moving relative to the band assembly, a series of raised bumps or other projections may be formed on the inner band surface 18 or outer band surface 20 to frictionally engage the high friction material. In another case holes may be located in the band to secure the high friction to the band, either by mechanically inserting the high friction material into the holes via projections on the material or by the inner and outer layers of the material joining through the holes during the dipping/molding process.

Figure 2:
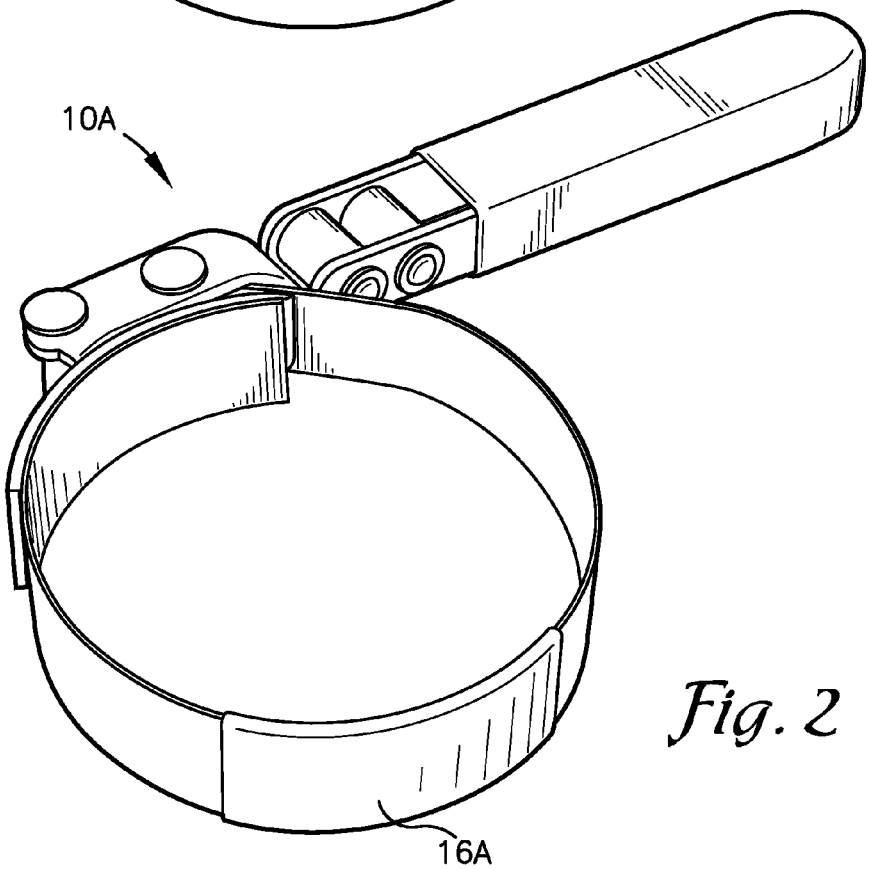
FIG. 2 is a perspective view of an oil filter wrench constructed in accordance with another embodiment of the present invention.

FIG. 2 illustrates an oil filter wrench 10A constructed in accordance with another embodiment of the invention. This embodiment is similar to the oil filter wrench of FIG. 1 except that the high friction material 16A is applied over a lesser total portion of the band assembly.

Figure 3:
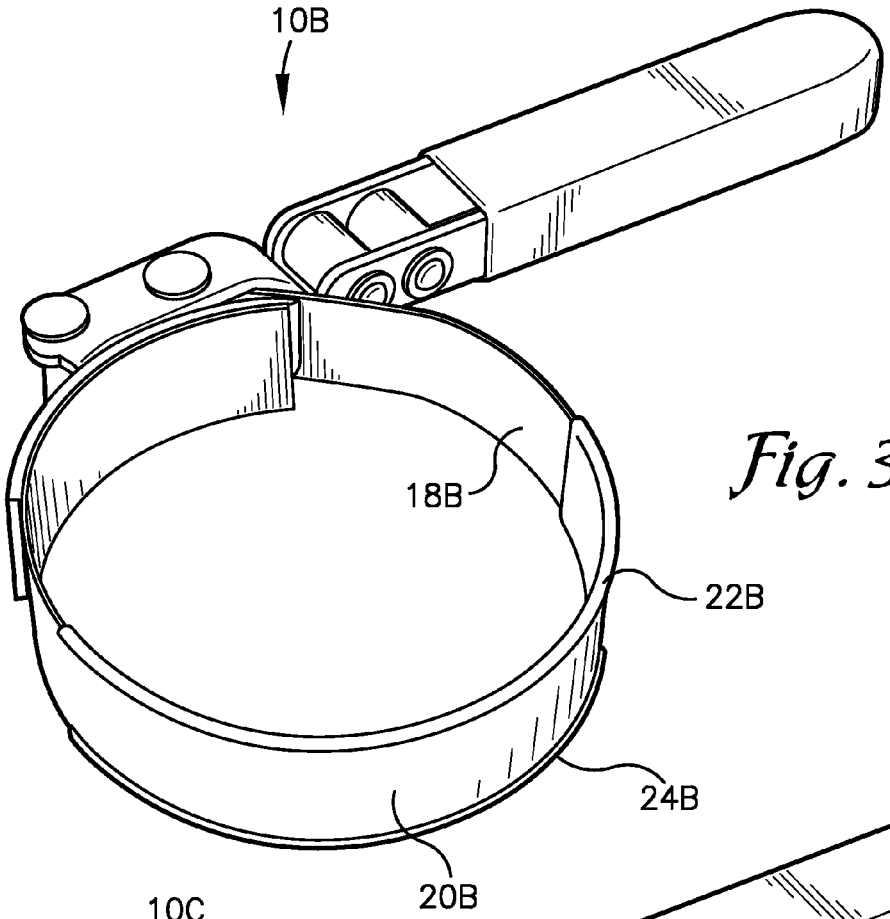
FIG. 3 is a perspective view of an oil filter wrench constructed in accordance with yet another embodiment of the present invention.

FIG. 3 illustrates an oil filter wrench 10B constructed in accordance with yet another embodiment of the invention. This embodiment is similar to the oil filter wrench of FIG. 1 except that the high friction material 16B is applied over a portion of the inner band surface 18B and side edges 22B,24B but not the outer band surface 20B.

Figure 4:
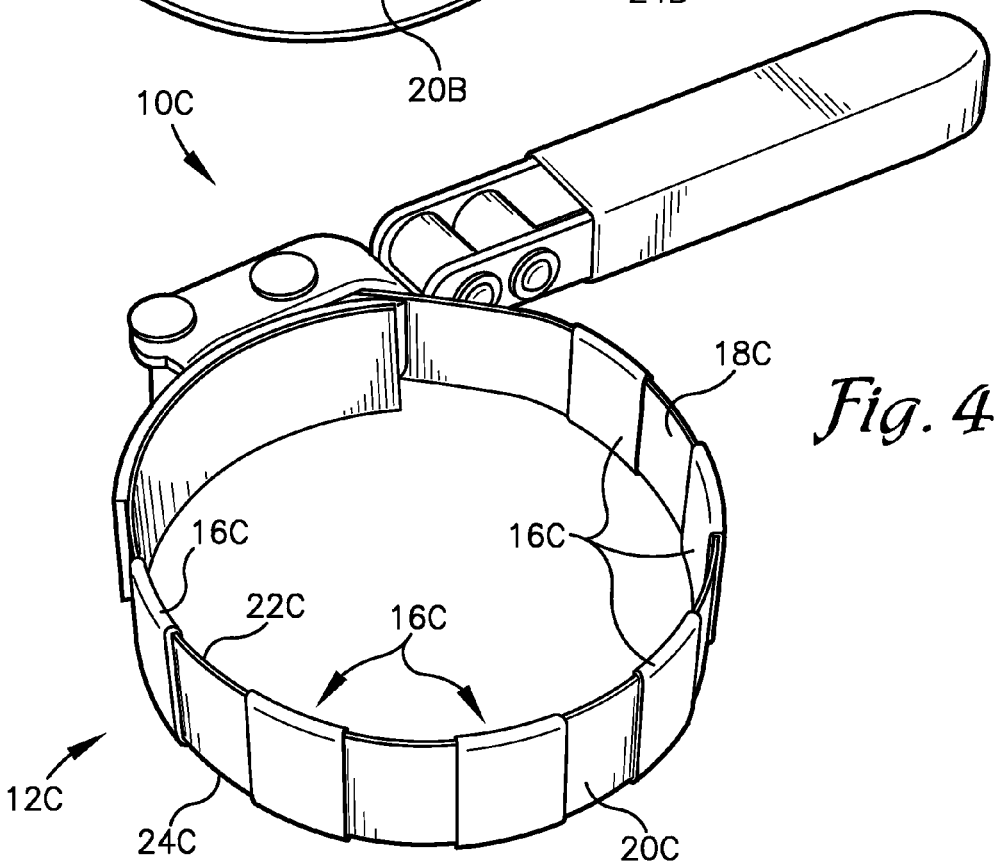
FIG. 4 is a perspective view of an oil filter wrench constructed in accordance with yet another embodiment of the present invention.

FIG. 4 illustrates an oil filter wrench 10C constructed in accordance with yet another embodiment of the invention. This embodiment is similar to the oil filter wrench of FIG. 1 except that the high friction material 16C is applied in a series of spaced-apart strips. The strips 16C extend perpendicular to a longitudinal axis of the band assembly 12A and wrap around a portion of the inner band surface 18C, outer band surface 20C, and side edges 22C,24C. The strips 16C may be of any size and spaced any distance apart. In one embodiment, the oil filter wrench includes 4 to 8 of such strips, with each strip being approximately ¼-¾ inches wide, and the strips being spaced ¼-¾ inches apart.

Figure 5:
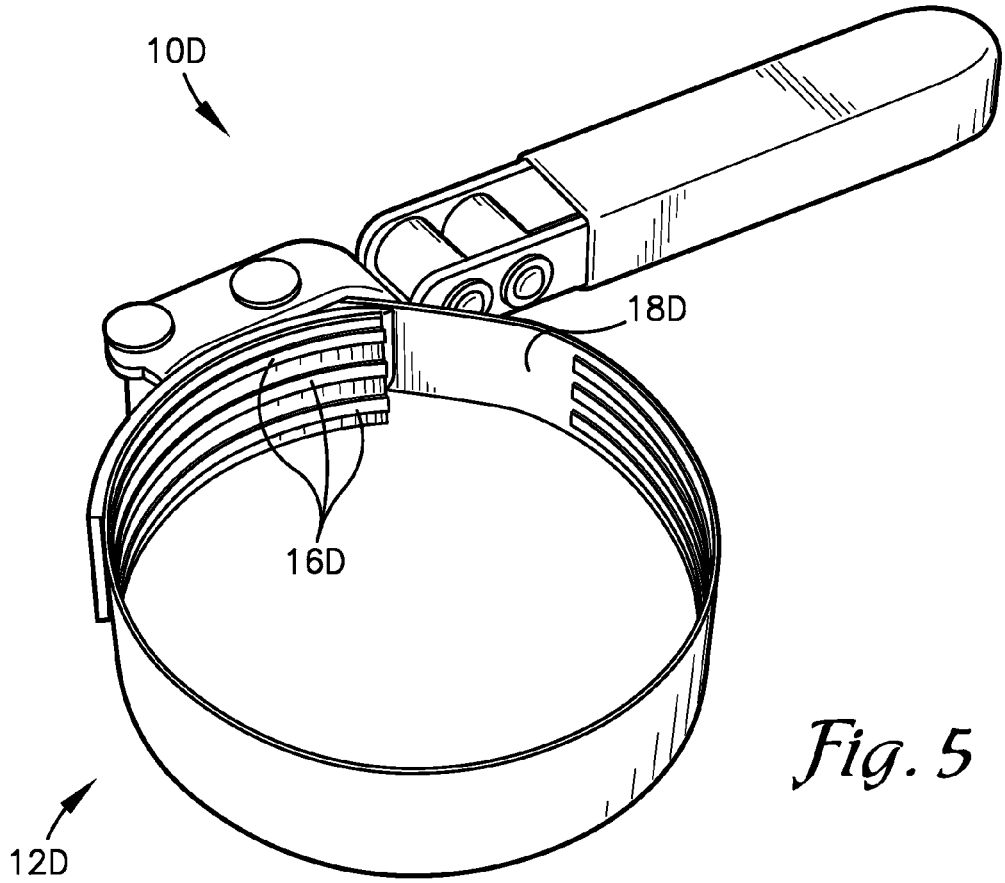
FIG. 5 is a perspective view of an oil filter wrench constructed in accordance with yet another embodiment of the present invention.

FIG. 5 illustrates an oil filter wrench 10D constructed in accordance with another embodiment of the invention. This embodiment is similar to the oil filter wrench 10C of FIG. 4 except that the spaced-apart strips 16D extend parallel to a longitudinal axis of the band assembly 12D and are applied over a portion of the inner band surface 18D only. The strips 16D may be of any size and spaced any distance apart. In one embodiment, the oil filter wrench includes 3 to 5 of such strips, with each strip being approximately ⅛-⅜ inches wide, and the strips being spaced ⅛-⅜ inches apart. Note that in this case, the strips may be only on the inner surface of the band or may be on both the inner and outer surface, especially if holes through the band are used. But the strips on both sides could also be accomplished by mechanical bonding (as snaps) between the two strips.

Although the invention has been described with reference to the preferred embodiment illustrated in the attached drawing figures, it is noted that equivalents may be employed and substitutions made herein without departing from the scope of the invention as recited in the claims. For example, the high friction material 16,16A,16B,16C,16D describe and illustrated herein may be applied to any oil filter wrench, not just the particular wrench described and illustrated herein.

Having thus described the preferred embodiment of the invention, what is claimed as new and desired to be protected by Letters Patent includes the following:

1. An oil filter wrench for tightening or loosening an oil filter, the oil filter wrench comprising:

a band assembly configured to be placed over the oil filter, the band assembly having an inner band surface, an outer band surface, and side edges between the inner band surface and the outer band surface;

a handle assembly attached to the band assembly for tightening and turning the band assembly to tighten or loosen the oil filter; and a layer of high friction material applied over a majority of the inner band surface, wherein the layer includes a plurality of raised strips that extend parallel to a longitudinal axis of the band assembly and across substantially all of a length of the inner band surface to reduce slippage between the inner band surface and the oil filter, wherein the plurality of strips covers at least 25% of the inner band surface and the high friction material is applied to the band assembly in a dipping process or in a powder coating process.

2. An oil filter wrench for tightening or loosening an oil filter, the oil filter wrench comprising:

a band assembly configured to be placed over the oil filter, the band assembly having an inner band surface, an outer band surface, and side edges between the inner band surface and the outer band surface;

a handle assembly attached to the band assembly for tightening and turning the band assembly to tighten or loosen the oil filter; and a series of holes located on the band for securing a high friction material to the band, the high friction material being inserted into the holes via projections on the material to reduce slippage between the inner band surface and the oil filter.

3. The oil filter wrench as set forth in claim 2, wherein the high friction material covers approximately 50% of the inner band surface.

4. The oil filter wrench as set forth in claim 2, wherein the high friction material covers approximately 25% of the inner band surface.

5. The oil filter wrench as set for in claim 2, wherein the series of holes includes 2-8 holes.

6. The oil filter wrench as set forth in claim 2, wherein the high friction material is PVC material that is approximately 0.030" thick.

7. The oil filter wrench as set forth in claim 2, wherein the high friction material is applied to the band assembly in a dipping process, injection or compression molding process, or a powder coating process, or by mechanical or adhesive attachment.

8. The oil filter wrench as set forth in claim 2, wherein the holes are aligned in a pattern substantially parallel to a longitudinal axis of the oil filter wrench.

9. The oil filter wrench as set forth in claim 2, wherein the holes are aligned in a pattern substantially perpendicular to a longitudinal axis of the oil filter wrench.

10. An oil filter wrench for tightening or loosening an oil filter, the oil filter wrench comprising:

a band assembly configured to be placed over the oil filter, the band assembly having an inner band surface, an outer band surface, and side edges between the inner band surface and the outer band surface;

a handle assembly attached to the band assembly for turning the band assembly to tighten or loosen the oil filter; and a series of holes located on the band for securing a high friction material to the band, the high friction material being inserted into the holes via projections on the material to reduce slippage between the inner band surface and the oil filter, wherein the high friction material covers at least 25% of the inner band surface, the series of holes includes 2-8 holes, the high friction material is PVC material that is approximately 0.030" thick, the holes are aligned in a pattern substantially parallel to a longitudinal axis of the oil filter wrench, and the high friction material is applied to the band assembly in a dipping process, mechanical or adhesive attachment, injection or compression molding process, or a powder coating process.

* * * * *